US009969511B2

(12) United States Patent
Newell et al.

(10) Patent No.: US 9,969,511 B2
(45) Date of Patent: May 15, 2018

(54) METHOD AND APPARATUS FOR SHRINKING END SEAMS AROUND A PRODUCT

(71) Applicants: Ernest C. Newell, Rocky Mount, NC (US); Yasutaka Suga, Ibaraki (JP)

(72) Inventors: Ernest C. Newell, Rocky Mount, NC (US); Yasutaka Suga, Ibaraki (JP)

(73) Assignees: OSSID LLC, Rocky Mount, NC (US); IBARAKI SEIKI CO., LTD., Osaka (JP)

( * ) Notice: Subject to any disclaimer, the term of this patent is extended or adjusted under 35 U.S.C. 154(b) by 1158 days.

(21) Appl. No.: 14/155,800

(22) Filed: Jan. 15, 2014

(65) Prior Publication Data

US 2014/0202117 A1 Jul. 24, 2014

Related U.S. Application Data

(60) Provisional application No. 61/756,282, filed on Jan. 24, 2013.

(51) Int. Cl.
*B65B 53/02* (2006.01)
*B65B 53/06* (2006.01)

(52) U.S. Cl.
CPC ..... *B65B 53/02* (2013.01); *B65B 53/06* (2013.01); *B65B 53/066* (2013.01)

(58) Field of Classification Search
None
See application file for complete search history.

(56) References Cited

U.S. PATENT DOCUMENTS 3,060,655 A * 10/1962 Dreyfus ..... B65B 53/06 53/442
3,309,835 A * 3/1967 Peppler ..... B65B 53/063 34/225

(Continued)

FOREIGN PATENT DOCUMENTS

GB 1425302 A * 2/1976 ..... B65B 53/06
GB 2119341 A * 11/1983 ..... B65B 53/04

(Continued)

OTHER PUBLICATIONS

PCT, International Search Report and Written Opinion, International Application No. PCT/US2014/011600 (dated May 12, 2014).

*Primary Examiner* — Hemant M Desai
*Assistant Examiner* — Tanzim Imam
(74) *Attorney, Agent, or Firm* — Thompson Hine LLP

(57) ABSTRACT

A method for shrinking selected spaced apart portions of film wrapped around a series of products of similar dimension being conveyed by a conveyor along a path in a selected direction is provide. The method involves the steps of: (a) indexing the conveyor and stopping the conveyor; (b) while the conveyor is stopped, causing heated fluid to flow from one or more nozzles so that a first heated fluid flow impinges upon selected portions of film in the vicinity of a product leading edge and a second heated fluid flow impinges upon selected portion of film in the vicinity of a product trailing edge; (b) repeating steps (a) and (b) multiple times so that, for multiple instances of the product, selected portions of film along both trailing and leading edges of each instance of the product are caused to shrink.

20 Claims, 4 Drawing Sheets

(56) References Cited

U.S. PATENT DOCUMENTS 3,402,475 A 9/1968 Johansen, et al.
3,457,695 A * 7/1969 McCollough ..... B65B 9/213 53/254
3,590,549 A 7/1971 Zelnick
3,599,394 A * 8/1971 Vilen ..... B65B 51/10 219/388
3,619,970 A * 11/1971 Zelnick ..... B65B 9/06 206/497
3,717,939 A * 2/1973 Mitchell ..... B65B 53/063 34/224
3,793,798 A 2/1974 Lancaster, III et al.
3,826,017 A * 7/1974 Kostur ..... B65B 53/063 34/225
3,830,036 A 8/1974 Harkness et al.
4,041,674 A * 8/1977 Reid ..... B65B 9/02 198/418.5
4,041,677 A * 8/1977 Reid ..... B65B 9/026 198/419.3
4,074,506 A * 2/1978 Sander ..... B65B 5/045 53/373.5
4,263,725 A * 4/1981 Ganz ..... B65B 53/063 34/231
4,538,363 A 9/1985 Zagoroff
4,719,332 A * 1/1988 Markuson, Jr. ..... B29C 61/00 219/388
4,783,950 A 11/1988 Santagati
4,858,416 A 8/1989 Monaghan
4,951,448 A 8/1990 Schmechel
5,050,368 A * 9/1991 Noh ..... B65B 61/02 34/218
5,299,406 A * 4/1994 Laury ..... B65B 53/02 53/134.1
5,398,427 A * 3/1995 Tolson ..... B65B 53/02 34/216
5,400,570 A * 3/1995 Bennett ..... B65B 53/04 34/216
5,519,983 A 5/1996 Moen
5,546,677 A * 8/1996 Tolson ..... B65B 53/063 34/216
5,746,041 A * 5/1998 Tolson ..... B65B 53/06 53/442
5,787,682 A * 8/1998 Tolson ..... B65B 53/063 53/442
6,648,634 B2 * 11/2003 Nava ..... B65B 53/063 432/121
6,810,645 B2 11/2004 Cerf
7,143,569 B2 12/2006 Limousin
2007/0071868 A1 * 3/2007 Iriarte ..... B65B 53/063 426/582
2010/0031608 A1 * 2/2010 Schilling ..... B65B 53/06 53/442

FOREIGN PATENT DOCUMENTS

JP 11180415 A * 7/1999
WO 02/36436 5/2002

* cited by examiner

METHOD AND APPARATUS FOR SHRINKING END SEAMS AROUND A PRODUCT

TECHNICAL FIELD

This application relates generally to methods and apparatus for shrinking of a heat shrinkable film wrapped around a product, and more particularly to methods and apparatus for shrinking selected portions of the film adjacent end seams formed by the film wrap, using an intermittent motion of the products.

BACKGROUND

A product is typically wrapped in a heat shrinkable film by a process which results in forming an end seam by the application of heat transversely between sequential products. The film is then generally shrunk. The film around each wrapped product has a leading transverse end seam and a trailing transverse end seam. The shrinking is usually done by the application to the film of a heated fluid, typically a gas such as air or steam or a liquid such as water. This shrinking step is mainly undertaken in order to improve the appearance of the final package by the removal of wrinkles in the film.

A particularly important class of products for which film shrinking is needed is that of packaged food products, especially poultry parts. It is common to package poultry parts by (i) placing the poultry parts in a molded tray having a stiffening flange around its upper periphery and (ii) wrapping the tray and its contents in a heat shrinkable film. The film is then shrunk. There are certain problems inherent in packaging poultry parts in film which make the shrinking step particularly demanding in order to achieve a relatively smooth appearance. One of the problems is that the transverse end seams formed in the wrapping process typically extend outwardly beyond the tray flange after being sealed; it is desired to cause the sealed end seam to be hidden under the tray flange after shrinking. Another problem is that in cases where the height of the poultry product is greater than twice the height of the flange of the tray, the formed transverse end seams are higher than the flange. This situation makes shrinking the end seams so as to draw each end seam into a position under the flange especially difficult. Furthermore, the seam end portions at each package corner are frequently left extended after the film is shrunk so as to be visible beyond the package contours.

Government regulations require the marking of food storage and preparation information on the film. This marking is generally best done on the portion of film which is to be in contact with the bottom of the tray. If this film portion is shrunk by the direct application of heat, the printing frequently becomes distorted and difficult to read, thus not meeting the legibility standards set by the regulations.

Among the numerous prior patents which address the process of film shrinking are U.S. Pat. No. 5,193,290; U.S. Pat. No. 5,398,427; U.S. Pat. No. 5,546,677; and U.S. Pat. No. 5,787,682. The '290 and '427 patents disclose general film shrinking inventions and provide useful background. The '677 patent is directed to causing heat to be applied to the transverse seams of the film without directly heating the bottom film portion. The '677 patent discloses an invention in which the tray is turned 90° to travel "sideways" on its conveyor to facilitate end seam shrinkage. The '682 patent discloses an invention in which the tray is not turned sideways and moves continuously along a conveyor, with nozzles located below the conveyor. The nozzles are arranged to travel back and forth below the conveyor and their travel is timed such that the heated fluid from the first nozzle heats only the leading seam and the heated fluid from the second nozzle heats only the trailing seam. This arrangement, though effective, tends to be costly to manufacture and operate due to the need to move the nozzles during the process.

It would be desirable to provide a machine that does not require the packages to be turned sideways, that effectively shrinks portions of film at the end seams and that can be produced and operated in a more cost effective manner.

SUMMARY

In one aspect, a method for shrinking selected spaced apart portions of film wrapped around a series of products of similar dimension being conveyed by a conveyor along a path in a selected direction is provided. The method involves the steps of: (a) indexing the conveyor and stopping the conveyor; (b) while the conveyor is stopped, causing heated fluid to flow from one or more nozzles so that a first heated fluid flow impinges upon selected portions of film in the vicinity of a product leading edge and a second heated fluid flow impinges upon selected portion of film in the vicinity of a product trailing edge; (c) repeating steps (a) and (b) multiple times so that, for multiple instances of the product, selected portions of film along both trailing and leading edges of each instance of the product are caused to shrink. In one example, the flow of heated fluid is stopped during at least part of step (a).

In one example of the method of the preceding paragraph, in step (a) the conveyor is indexed by a set distance; in step (b), the product trailing edge is a trailing edge of a first instance of the product along the conveyor and the product leading edge is a leading edge of a second instance of the product along the conveyor, where the second instance of the product is upstream of the first instance of the product and is the next instance of the product along the conveyor.

In one example of the method of either of the two preceding paragraphs, a single nozzle produces both the first heated fluid flow and the second heated fluid flow.

In one example of the method of any of the three preceding paragraphs, each product has a similar first dimension in a direction parallel to selected direction, and the set distance is substantially the same as the first dimension plus a predefined gap spacing between products being conveyed along the path.

In one example of the preceding method aspect, in step (a) the conveyor is indexed by a set distance; in step (b), the product trailing edge is a trailing edge of a first instance of the product and the product leading edge is a leading edge of the first instance of the product.

In one example of the method of the preceding paragraph, a first nozzle produces the first heated fluid flow and a second nozzle produces the second heated fluid flow.

In one example of the method of either of the two preceding paragraphs, each product has a similar first dimension in a direction parallel to selected direction, and the set distance is substantially the same as the first dimension plus a predefined gap spacing between products being conveyed along the path.

In one example of the preceding method aspect, in step (a) the conveyor is indexed until an instance of the product is detected to be in a suitable position for treatment by heated fluid flow.

In one example of the method of the preceding paragraph, a photo-detector is used for detection purposes.

In one example of the method of either of the two preceding paragraphs, the product trailing edge is a trailing edge of a first instance of the product and the product leading edge is a leading edge of the first instance of the product.

In another aspect, a method for shrinking selected spaced apart portions of film wrapped around a product that is one of a series of products of similar dimension being conveyed by a conveyor along a path in a selected direction is provided. The method involves the steps of: (a) based upon a first dimension of the products, locating a hot air nozzle at a specific position along the path, where the first dimension runs parallel to the selected direction; (b) in relation to a given instance of the product on the conveyor: (i) indexing the conveyor by a set distance that moves an edge of the product into position such that heated fluid exiting the nozzle will impinge upon selected portions of film in the vicinity of the edge; (ii) stopping the conveyor after indexing by the set distance; (iii) when the conveyor is stopped, causing heated fluid to flow from the nozzle to impinge upon the selected portions of film; (iv) thereafter indexing the conveyor by the set distance.

In one example, the nozzle is configured to provide both a first heated fluid flow and a second heated fluid flow; during step (b)(i): the given instance of the product is moved so that its trailing edge is in position such that the first heated fluid flow will impinge upon selected portions of film in the vicinity of the trailing edge; and a following instance of the product is moved so that its leading edge is in position such that the second heated fluid flow will impinge upon selected portions of film in the vicinity of the leading edge of the following instance of the product; during step (b)(iii), both the first heated fluid flow and second heated fluid flow are produced.

In one example, during step (b)(iv): the given instance of the product is moved away from the nozzle; the following instance of the product is moved so that its trailing edge is in position such that the first heated fluid flow will impinge upon selected portions of film in the vicinity of the trailing edge of the following instance of product; and a next following instance of the product is moved so that its leading edge is in position such that the second heated fluid flow will impinge upon selected portions of film in the vicinity of the leading edge of the next following instance of the product; the conveyor is stopped after indexing by the set distance; following step (b)(iv): when the conveyor is stopped, producing both the first heated fluid flow and the second heated fluid flow.

In one example, in step (a) the nozzle is positioned further downstream along the path for increasing size of the first dimension.

In one example, the set distance is substantially the same as the first dimension plus a predefined gap spacing between products being conveyed along the path.

In one example, the nozzle is a first nozzle, a second nozzle is spaced apart from the first nozzle by a distance corresponding to the first dimension; during step (b)(i): the given instance of the product is moved so that (1) one of its trailing edge or its leading edge is in position so that heated fluid exiting the first nozzle will impinge upon selected portions of film in the vicinity of the one edge and (2) the other of its trailing edge or its leading edge is in position so that heated fluid exiting the second nozzle will impinge upon selected portions of film in the vicinity of the other edge.

In one example, during step (b)(iv): the given instance of the product is moved away from both the first nozzle and the second nozzle; a following instance of the product is moved so that one of its trailing edge or its leading edge is in position so that heated fluid exiting the first nozzle will impinge upon selected portions of film in the vicinity of the one edge of the following instance of the food product; and the following instance of the product is moved so that the other of its trailing edge or its leading edge is in position so that heated fluid exiting the second nozzle will impinge upon selected portions of film in the vicinity of the other edge of the following instance of the food product; the conveyor is stopped after indexing by the set distance; following step (b)(iv): when the conveyor is stopped, producing both the first heated fluid flow and the second heated fluid flow.

In one example, in step (a) position of both the first nozzle and the second nozzle are set based upon the first dimension.

In one example, the position of the second nozzle is fixed and in step (a) only the position of the first nozzle is set based upon the first dimension.

In one example, in step (b)(iii) the heated fluid is caused to flow for a set time period or a set amount of heated fluid flow, and is thereafter stopped.

In a further aspect, a method for shrinking selected spaced apart portions of film wrapped around a product which is one of a series of products of similar dimension being conveyed by a conveyor along a path in a selected direction, said method comprising the steps of: (a) based upon a first dimension of the products, locating a first hot air nozzle at a specific position along the path, where the first dimension runs parallel to the selected direction, a second hot air nozzle also being located along the path and spaced from the first hot air nozzle; (b) in relation to a given instance of the product on the conveyor: (i) indexing the conveyor until the product is detected to be in a position such that heated fluid exiting the first nozzle will impinge upon selected portions of film in the vicinity of one of a trailing or leading edge of the product and heated fluid flow exiting the second nozzle will impinge upon selected portions of film in the vicinity of the other of the trailing edge or leading edge of the product; (ii) stopping the conveyor after indexing; (iii) when the conveyor is stopped, causing heated fluid to flow from the first nozzle and the second nozzle to impinge upon the selected portions of film for a set time period or a set amount of heated fluid flow, and then stopping the heated fluid flow; (iv) thereafter indexing the conveyor until a next instance of the product is detected to be in a position suitable for treatment.

In another aspect, an apparatus for shrinking selected spaced apart portions of film wrapped around a series of products of similar dimension includes a conveyor for conveying the products along a path in a selected direction. One or more fluid nozzles are position below the path for selectively outputting a heated fluid flow. A controller is configured to operate the apparatus so as to carry out the steps of: (a) indexing the conveyor and stopping the conveyor with product at a desired location; (b) while the conveyor is stopped, causing heated fluid to flow from the one or more nozzles so that a first heated fluid flow impinges upon selected portions of film in the vicinity of a product leading edge and a second heated fluid flow impinges upon selected portion of film in the vicinity of a product trailing edge; (c) stopping the flow of heated fluid; (d) repeating steps (a) through (c) multiple times so that, for multiple instances of the product, selected portions of film along both trailing and leading edges of each instance of the product are caused to shrink.

DETAILED DESCRIPTION

Generally, a method for shrinking selected spaced apart portions of film wrapped around a product that is one of a series of products of similar dimension being conveyed by a conveyor along a path in a selected direction is provided The method involves: (a) based upon a first dimension of the products, locating a hot air nozzle at a specific position along the path, where the first dimension runs parallel to the selected direction; and (b) in relation to a given instance of the product on the conveyor: (i) indexing the conveyor by a set distance that moves an edge of the product into position such that heated fluid exiting the nozzle will impinge upon selected portions of film in the vicinity of the edge; (ii) stopping the conveyor after indexing by the set distance; (iii) when the conveyor is stopped; (iv) thereafter indexing the conveyor by the set distance. In certain embodiments, the heated fluid is caused to flow for a set time period or a set amount of heated fluid flow, and is thereafter stopped, or in some cases reduced, until a next product is moved into position.

Moreover, a method for shrinking selected spaced apart portions of film wrapped around a series of products of similar dimension being conveyed by a conveyor along a path in a selected direction is provided. The method involves: (a) indexing the conveyor and stopping the conveyor; (b) while the conveyor is stopped, causing heated fluid to flow from one or more nozzles so that a first heated fluid flow impinges upon selected portions of film in the vicinity of a product leading edge and a second heated fluid flow impinges upon selected portion of film in the vicinity of a product trailing edge; (c) repeating steps (a) and (b) multiple times so that, for multiple instances of the product, selected portions of film along both trailing and leading edges of each instance of the product are caused to shrink. In certain embodiments, the flow of heated fluid is stopped, or at least reduced, during all of step (a) or at least part of step (a).

Figure 1B:
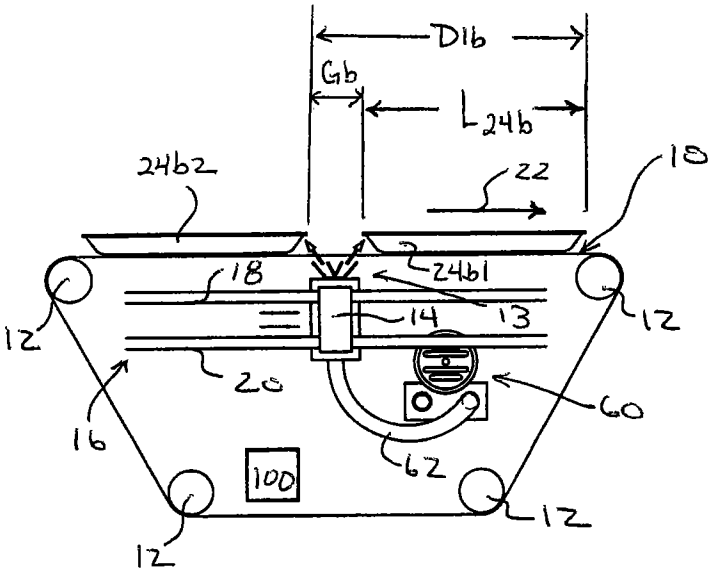
FIGS. 1*a* and 1*b* show an embodiment in which two instances of product are simultaneously treated with heated fluid, with FIG. 1*a* showing nozzle positioning suited for a product of one dimension and FIG. 1*b* showing nozzle positioning suitable for a product of a larger dimension.
Figure 1A:
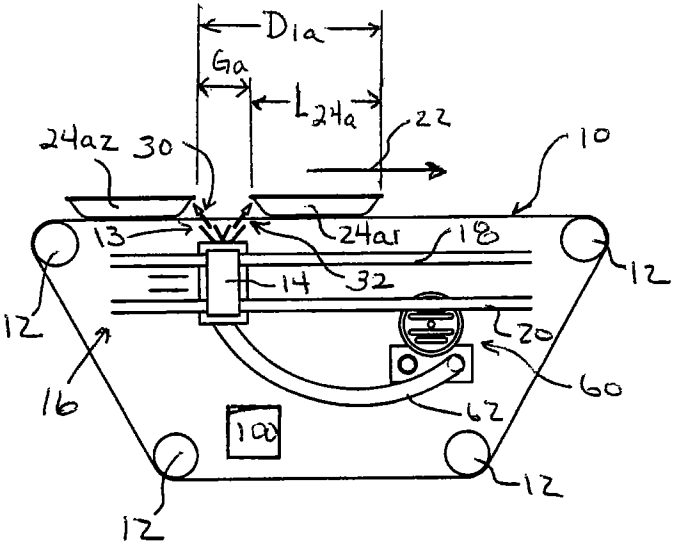

Referring now to the embodiment of FIGS. 1*a* and 1*b*, the conveyor 10 is shown as looped around a path defined by rollers 12, at least one of which may provide motive power for the conveyor. A single nozzle assembly 13 is mounted (e.g., via a frame 14) along a rail system 16, which may include an upper slide rod 18 and a lower adjustment rod 20. A air source 60 and flexible tubing, hose or other duct system 62 to supply the air to the nozzle assembly is also shown. The air may be heated at either the upstream or downstream side of the supply hose/duct 62. The lower adjustment rod 20 may be threadedly engaged with a lower portion of the frame 14, so that rotation of the rod 20 (e.g., by rotation of a wheel affixed to one end of the rod) causes movement of the nozzle to the left or right depending upon the direction of rod rotation. In an alternative embodiment, a different adjustment mechanism may be provided. For example, both rods 18 and 20 could be slide rods and the nozzle may include a clamp system with a non-clamped orientation that allows the nozzle to slide and a clamped orientation that fixes the nozzle in position (e.g., by clamping against the rod 20).

The direction of movement of the portion of the conveyor 12 with product thereon is left to right as indicated by arrow 22. The position of the nozzle 13 is set according to a dimension of the product in the direction that is parallel with direction 22. By way of example, in FIG. 1*a* the product 24*a* has a dimension $L_{24a}$ that is significantly smaller than the dimension $L_{24b}$ of the product 24*b* of FIG. 1*b*. The position of the nozzle 13 is set accordingly in each case so that the nozzle 13 will be positioned in between two adjacent instances of the product traveling along the conveyor 10. Once the nozzle position is set according to the product to be processed, the nozzle position remains fixed during the shrink process, which is carried out for a sequence of the products of similar dimension.

Thus, in the embodiment of FIGS. 1*a* and 1*b*, the nozzle 13 is configured to provide both a heated fluid flow 30 and a heated fluid flow 32 (in this case each flow shown as upward and slightly outward from the nozzle). During indexing of the conveyor 10 by the set distance, a leading instance (24*a*1 or 24*b*1) of the product is moved so that its trailing edge is in position such that the heated fluid flow 32 will impinge upon selected portions of film in the vicinity of the trailing edge, and a following instance (24*a*2 or 24*b*2) of the product is moved so that its leading edge is in position such that the heated fluid flow 30 will impinge upon selected portions of film in the vicinity of the leading edge of the following instance of the product. Both of the heated fluid flows 30 and 32 are produced substantially simultaneously while the conveyor 10 is stopped and the instances of product are in the illustrated positions.

Figure 1C:
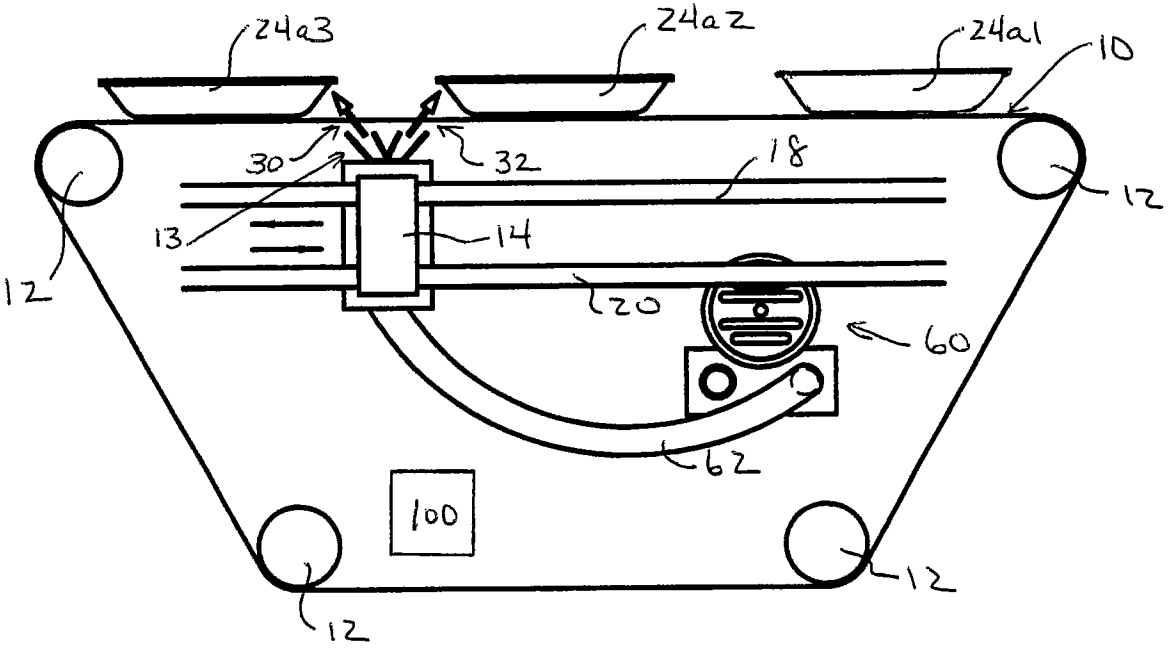
FIG. 1*c* shows a next stage of the arrangement shown in FIG. 1*a;*

As seen in FIG. 1*c*, in the embodiment of FIGS. 1*a* and 1*b*, when the conveyor is again indexed, the leading instance of the product (e.g., instance 24*a*1) is moved away from the nozzle 13. The following instance of the product 24*a*2 is moved so that its trailing edge is in position such that the heated fluid flow 32 will impinge upon selected portions of film in the vicinity of the trailing edge of the following instance of product. A next following instance of the product 24*a*3 is moved so that its leading edge is in position such that the heated fluid flow 30 will impinge upon selected portions of film in the vicinity of the leading edge of the next following instance of the product. The conveyor is stopped after indexing by the set distance, and then, while conveyor is stopped, both heated fluid flows 30 and 32 are produced. Repetition of this sequence enables multiple products to be treated with heated fluid without moving the nozzle during the flow of heated fluid.

In the embodiment of FIGS. 1*a*, 1*b* and 1*c*, the set distance for indexing of the product is larger than the product dimension (e.g., slightly larger than L24*a* or L24*b*) according to the gap G between the products so that each indexing operation will center the mid-point between the products in alignment with the nozzle. This set distance (e.g., D1*a* or D1*b*) typically corresponds to the cut length of the film applied by the upstream wrapping machine. In one arrangement, the indexing of the conveyor 10 may actually be controlled by the upstream wrapping machine, which indexes its own conveyor in a similar manner. In another arrangement the indexing of the conveyor may be controlled by a separate control (e.g., controller 100) that is synched with the upstream wrapping machine, and controls the indexing of the conveyor and the ejection of heated fluid from the nozzles at appropriate times. The additional embodiments described below may include a similar controller 100 as shown.

Figure 2B:
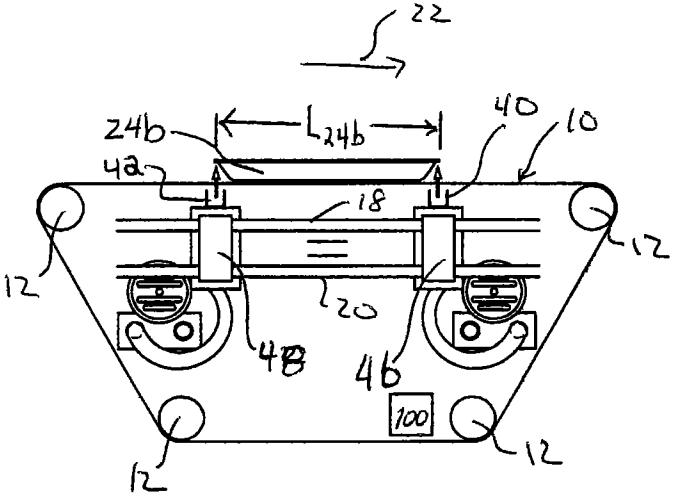
FIGS. 2*a* and 2*b* show and embodiment in which one instance of product is treated with heated fluid from two spaced apart nozzles, with FIG. 2*a* showing nozzle positioning suited for a product of one dimension and FIG. 2*b* showing nozzle positioning suitable for a product of a larger dimension.
Figure 2A:
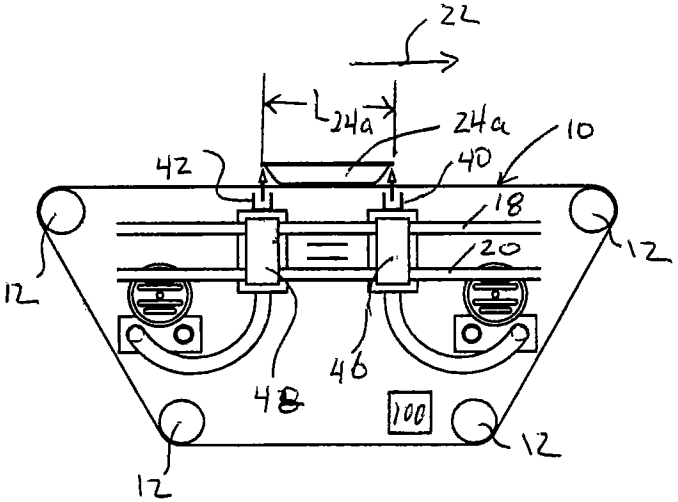

Referring now to the embodiment of FIGS. 2*a* and 2*b*, two nozzles 40 and 42 (e.g., supported by respective frames 46 and 48) are used, both being adjustable to different positions along the rail system 16. In one example of this embodiment, rotation of rod 20 in a given direction causes nozzle 40 to move in one direction and nozzle 42 top move in the opposite direction. Alternatively, a third adjustment rod (not shown) may be provided for adjusting the position of nozzle 42. In another alternative, in a two rod system as shown, both nozzles may simply be individually clamped to the rod 20, with each clamp being releasable to allow independent adjustment of each nozzle position. Both nozzles are positioned according to the dimension of the product in the direction of movement (e.g., $L_{24a}$ or $L_{24b}$), so that the spacing between the nozzles corresponds to the dimension (e.g., slightly large than this dimension). In this embodiment, during indexing of the conveyor a given instance of the product is moved so that (1) its trailing edge is in position so that heated fluid exiting the nozzle 42 will impinge upon selected portions of film in the vicinity of the trailing edge and (2) its leading edge is in position so that heated fluid exiting the nozzle 40 will impinge upon selected portions of film in the vicinity of the leading edge. Upon further indexing of the conveyor by a set distance, the given instance of the food product is moved away from the nozzles and a following instance of the food product (not shown) is moved into the position for heated fluid flow to impinge upon its leading and trailing edges. Repetition of this sequence enables multiple products of the same dimension to be treated with heated fluid sequentially without moving the nozzles during the flow of heated fluid.

In the embodiment of FIGS. 2*a* and 2*b*, the set distance for indexing of the product will be larger than the product dimension in the conveying direction (e.g., larger than L24*a* or L24*b*), and will typically substantially correspond to the product dimension plus the gap between the products. Again, this distance may correspond to the cut length of the film as mentioned above.

Figure 4:
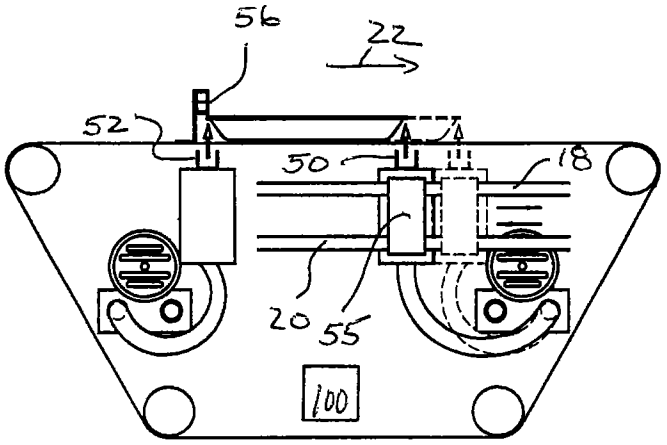
FIG. 4 shows another embodiment in which one instance of product is treated with heated fluid from two nozzles.
Figure 3:
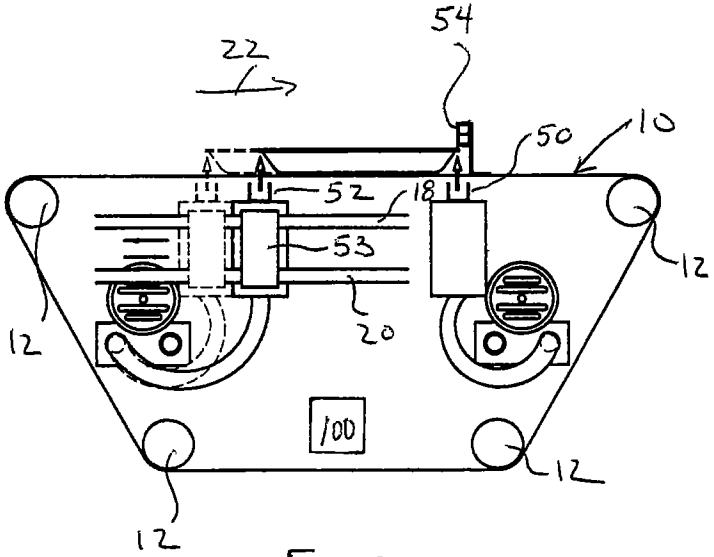
FIG. 3 shows another embodiment in which one instance of product is treated with heated fluid from two nozzles.

Referring to the embodiment of FIG. 3, one nozzle 50 is stationary and always fixed, regardless of product dimension, and another nozzle 52 is mounted (e.g., via frame 53) for position adjustment on the slide rod 18 and adjustment rod 20. The position of nozzle 52 is adjusted according to dimension of the product to be treated, so that the spacing between nozzles 50 and 52 corresponds to the spacing between the leading and trailing edges of the product to be treated. In this embodiment, rather than indexing the conveyor by a set distance, a photo-eye or other detector 54 is used to control the indexing of the conveyor so that the leading edge of the product to be treated is always located in the vicinity of the nozzle 50. Specifically, between each heat treat operation the conveyor 10 is moved until the leading edge of the next instance of product is detected by the photo-eye or other detector. FIG. 4 shows an embodiment that also utilizes a detector 56 to control conveyor indexing, but with the detector 56 positioned to detect the trailing edge of each instance of product for the purpose of stopping the trailing edge. In this instance, nozzle 52 is stationary, but nozzle 50 is movable (e.g., via frame mounting 55) to permit adjustment for various size products to be heat treated by the nozzles.

It is to be clearly understood that the above description is intended by way of illustration and example only, is not intended to be taken by way of limitation, and that other changes and modifications are possible.

What is claimed is:

1. A method for shrinking spaced apart end seam portions of film wrapped around a series of products of similar dimension being conveyed by a conveyor along a path in a selected linear direction, said method comprising the steps of:

(a) indexing the conveyor in the selected linear direction and stopping the conveyor;

(b) while the conveyor is stopped, causing heated fluid to flow from one or more nozzles positioned below the conveyor so that a first heated fluid flow impinges upon leading end seam portions of film in a vicinity of a product leading edge and a second heated fluid flow impinges upon trailing end seam portions of film in a vicinity of a product trailing edge;

(c) repeating steps (a) and (b) multiple times so that, for multiple instances of the product, leading end seam portions of film and trailing end seam portions of film along both trailing and leading edges of each instance of the product are caused to shrink.

2. The method of claim 1 wherein the first heated fluid flow and the second heated fluid flow are stopped during at least part of step (a).

3. The method of claim 2 wherein:

in step (a) the conveyor is indexed by a set distance;

in step (b), the product trailing edge is a trailing edge of a first instance of the product along the conveyor and the product leading edge is a leading edge of a second instance of the product along the conveyor, wherein the second instance of the product is upstream of the first instance of the product and is a next instance of the product along the conveyor.

4. The method of claim 3 wherein a single nozzle produces both the first heated fluid flow and the second heated fluid flow.

5. The method of claim 4 wherein each product has a similar first dimension that runs parallel to the selected linear direction, and the set distance is the same as the first dimension plus a predefined gap spacing between products being conveyed along the path.

6. The method of claim 2 wherein:

in step (a) the conveyor is indexed by a set distance;

in step (b), the product trailing edge is a trailing edge of a first instance of the product and the product leading edge is a leading edge of the first instance of the product.

7. The method of claim 6 wherein:

a first nozzle produces the first heated fluid flow and a second nozzle produces the second heated fluid flow.

8. The method of claim 2 wherein:

in step (a) the conveyor is indexed until an instance of the product is detected to be in a suitable position for treatment by heated fluid flow.

9. The method of claim 8 wherein a photo-detector is used for detecting whether an instance of the product is in a suitable position for treatment by heated fluid flow.

10. The method of claim 8 wherein the product trailing edge is a trailing edge of a first instance of the product and the product leading edge is a leading edge of the first instance of the product.

11. The method of claim 1 wherein each product has a similar first dimension that runs parallel to the selected linear direction, a position of at least one nozzle of the one or more nozzles is adjustable along the path, and prior to carrying out steps (a) through (c), the position of the at least one nozzle of the one or more nozzles is set based at least in part upon the first dimension.

12. A method for shrinking end seams of film wrapped around a product that is one of a series of products of similar dimension being conveyed by a conveyor along a path in a selected linear direction, said method comprising the steps of:

(a) based upon a first dimension of the products, locating a hot air nozzle at a specific position along the path and below the conveyor, wherein the first dimension runs parallel to the selected linear direction;

(b) in relation to a given instance of the product on the conveyor:

(i) indexing the conveyor in the selected linear direction by a set distance that moves an edge of the given instance of the product into position such that heated fluid exiting the nozzle will impinge upon a first end seam of film in a vicinity of the edge;

(ii) stopping the conveyor after indexing by the set distance;

(iii) when the conveyor is stopped, causing heated fluid to flow from the nozzle to impinge upon the first end seam of film;

(iv) thereafter indexing the conveyor in the selected linear direction by the set distance.

13. The method of claim 12 wherein:

the nozzle is configured to provide both a first heated fluid flow and a second heated fluid flow;

during step (b)(i):

the edge is a trailing edge of the given instance of the product, the first end seam of film is a trailing end seam of film, and the given instance of the product is moved so that the trailing edge is in position such that the first heated fluid flow will impinge upon the trailing end seam of film in a vicinity of the trailing edge; and a following instance of the product is moved so that a leading edge of the following instance of the product is in position such that the second heated fluid flow will impinge upon a leading end seam of film in a vicinity of the leading edge of the following instance of the product;

during step (b)(iii), both the first heated fluid flow and second heated fluid flow are produced.

14. The method of claim 13 wherein:

during step (b)(iv):

the given instance of the product is moved away from the nozzle;

the following instance of the product is moved so that a trailing edge of the following instance of the product is in position such that the first heated fluid flow will impinge upon a trailing end seam of film in a vicinity of the trailing edge of the following instance of the product; and a next following instance of the product is moved so that a leading edge of the next following instance of the product is in position such that the second heated fluid flow will impinge upon a leading end seam of film in a vicinity of the leading edge of the next following instance of the product;

the conveyor is stopped after indexing by the set distance;

following step (b)(iv):

when the conveyor is stopped, producing both the first heated fluid flow and the second heated fluid flow.

15. The method of claim 13 wherein in step (a) the nozzle is positioned further downstream along the path for increasing size of the first dimension.

16. The method of claim 12 wherein the set distance is the same as the first dimension plus a predefined gap spacing between products being conveyed along the path.

17. The method of claim 12 wherein in step (b)(iii) the heated fluid is caused to flow for a set time period or a set amount of heated fluid flow, and is thereafter stopped.

18. A method for shrinking spaced apart end seam portions of film wrapped around a series of products of similar dimension being conveyed by a conveyor along a path in a linear direction, said method comprising the steps of:

(a) indexing the conveyor and stopping the conveyor;

(b) while the conveyor is stopped, causing heated fluid to flow from one or more nozzles so that a first heated fluid flow impinges upon a leading end seam portion of film in a vicinity of a product leading edge and a second heated fluid flow impinges upon a trailing end seam portion of film in a vicinity of a product trailing edge;

(c) repeating steps (a) and (b) multiple times so that, for multiple instances of the product, a leading end seam portion of film and a trailing end seam portion of film along respective leading and trailing edges of each instance of the product are caused to shrink;

wherein:

in step (a) the conveyor is indexed by a set distance;

in step (b), the product trailing edge is a trailing edge of a first instance of the product along the conveyor and the product leading edge is a leading edge of a second instance of the product along the conveyor, wherein the second instance of the product is upstream of the first instance of the product in the linear direction and is a next instance of the product along the conveyor.

19. The method of claim 18 wherein a single nozzle produces both the first heated fluid flow and the second heated fluid flow.

20. The method of claim 19 wherein each product has a similar first dimension that runs parallel to the linear direction, and the set distance is the same as the first dimension plus a predefined gap spacing between products being conveyed along the path.

* * * * *